US010729305B2

(12) United States Patent
Kopyrin et al.

(10) Patent No.: US 10,729,305 B2
(45) Date of Patent: Aug. 4, 2020

(54) COLLAPSIBLE DISH RACK FOR DISHWASHER

(71) Applicant: Samsung Electronics Co., Ltd., Suwon-si (KR)

(72) Inventors: Viktor Kopyrin, Grosse Pointe Shores, MI (US); Raveendran Vaidhyanathan, Riverwoods, IL (US)

(73) Assignee: Samsung Electronics Co., Ltd., Suwon-si (KR)

( * ) Notice: Subject to any disclaimer, the term of this patent is extended or adjusted under 35 U.S.C. 154(b) by 339 days.

(21) Appl. No.: 15/197,564

(22) Filed: Jun. 29, 2016

(65) Prior Publication Data

US 2017/0265713 A1 Sep. 21, 2017

Related U.S. Application Data

(60) Provisional application No. 62/310,397, filed on Mar. 18, 2016.

(51) Int. Cl.
*A47L 15/50* (2006.01)
*A47L 15/23* (2006.01)

(52) U.S. Cl.
CPC ..... *A47L 15/504* (2013.01); *A47L 15/23* (2013.01); *A47L 15/507* (2013.01); *A47L 15/508* (2013.01)

(58) Field of Classification Search
CPC .... A47L 15/504; A47L 15/508; A47L 15/507; A47L 15/506; A47L 15/50; A47L 15/502; A47L 15/4217

(Continued)

(56) References Cited

U.S. PATENT DOCUMENTS 3,306,693 A * 2/1967 Kauffman ..... A47L 15/506 134/143
3,472,573 A * 10/1969 Geiger ..... A47L 15/504 312/311

(Continued)

FOREIGN PATENT DOCUMENTS

| | | |
|---|---|---|
| EP | 1161917 | 12/2001 |
| WO | WO 2008/060029 | 5/2008 |
| WO | WO 2015/102358 | 7/2015 |

OTHER PUBLICATIONS

Wire Dump Bin w/ Adjustable Shelf, Floorstanding—White; Mar. 10, 2016; http://www.displays2go.com/P-8583/Wire-Basket-Adjustable-Shelf; 3 pages.

*Primary Examiner* — David G Cormier
*Assistant Examiner* — Thomas Bucci

(57) ABSTRACT

A dishwasher includes a tub, a first dish rack, and a second dish rack disposed above the first dish rack in the tub. The second dish rack includes a frame configured to couple to and adjust in a vertical position relative to a plurality of mounting rails in the tub. The second dish rack also includes a collapsible portion coupled to the frame and configured to adjust in a vertical position relative to the frame. In some embodiments, the second dish rack further includes a feed pipe coupled to the collapsible portion, the feed pipe having at least one connection point configured to align with at least one water supply point, wherein each vertical position of the collapsible portion corresponds to a different alignment of the at least one connection point and the at least one water supply point.

20 Claims, 20 Drawing Sheets

(58) Field of Classification Search
USPC ..... 134/172, 198, 56 D, 135, 58 D, 57 D, 134/165, 137, 180, 183; 211/41.8, 41.9, 211/181.1, 175, 190
See application file for complete search history.

(56) References Cited

U.S. PATENT DOCUMENTS 3,614,187 A * 10/1971 Cuthbert ..... A47L 15/507 312/351
3,734,589 A * 5/1973 Morgan ..... A47B 51/00 312/311
3,768,883 A * 10/1973 Kauffman ..... A47L 15/504 108/147
3,809,450 A * 5/1974 Guth ..... A47L 15/504 312/351
3,822,085 A * 7/1974 Clark ..... A47L 15/504 312/311
4,064,887 A * 12/1977 Geiger ..... A47L 15/23 134/144
4,097,099 A * 6/1978 Spiegel ..... A47L 15/504 312/311
5,860,716 A 1/1999 Good et al.
7,168,578 B2 1/2007 Mersch et al.
8,104,628 B2 1/2012 Kim
8,191,560 B2 6/2012 Mallory et al.
8,900,375 B2 12/2014 Gnadinger et al.
9,044,134 B2 6/2015 Park et al.
9,055,860 B2 6/2015 Roberson et al.
9,119,493 B2 9/2015 Jeong
2003/0042825 A1* 3/2003 Welch ..... A47L 15/504 312/228.1
2003/0075517 A1* 4/2003 Jahrling ..... A47L 15/504 211/41.8
2003/0192578 A1* 10/2003 Ochoa, Sr. ..... A47L 15/508 134/176
2003/0226580 A1* 12/2003 Welch ..... A47L 15/50 134/172
2004/0163687 A1 8/2004 Son et al.
2005/0001524 A1* 1/2005 Deiss ..... A47L 15/504 312/334.4
2005/0039782 A1* 2/2005 Kim ..... A47L 15/504 134/58 D
2005/0109378 A1* 5/2005 Landsiedel ..... A47L 15/14 134/135
2006/0119236 A1* 6/2006 Dickson ..... A47L 15/504 312/311
2007/0215187 A1 9/2007 Koch et al.
2008/0011337 A1* 1/2008 Ryu ..... A47L 15/504 134/147
2008/0072937 A1* 3/2008 Choi ..... A47L 15/502 134/137
2008/0110480 A1* 5/2008 Choi ..... A47L 15/503 134/135
2008/0156362 A1* 7/2008 Shin ..... A47L 15/502 134/201
2008/0272072 A1* 11/2008 Tynes ..... A47L 15/504 211/41.8
2009/0050186 A1* 2/2009 Kim ..... A47L 15/504 134/165
2009/0159101 A1* 6/2009 Clerkin ..... A47L 15/14 134/44
2010/0078048 A1* 4/2010 Schessl ..... A47L 15/502 134/115 R
2010/0314977 A1* 12/2010 Mallory ..... A47L 15/503 312/228.1
2012/0074080 A1* 3/2012 Garcia ..... A47B 46/005 211/41.9
2012/0291824 A1* 11/2012 Bhajak ..... A47L 15/504 134/135
2013/0139854 A1 6/2013 Lee et al.
2014/0137905 A1* 5/2014 Shin ..... A47L 15/504 134/135
2014/0196756 A1* 7/2014 Dries ..... A47L 15/22 134/198
2015/0002005 A1* 1/2015 Park ..... A47L 15/507 312/228.1
2015/0020856 A1 1/2015 Hong et al.

* cited by examiner

COLLAPSIBLE DISH RACK FOR DISHWASHER

CROSS-REFERENCE TO RELATED APPLICATION AND CLAIM OF PRIORITY

The present application claims priority to U.S. Provisional Patent Application Ser. No. 62/310,397 filed Mar. 18, 2016, entitled "COLLAPSIBLE RACK," the contents of which are incorporated herein by reference.

TECHNICAL FIELD

This disclosure relates generally to dishwasher appliances and more specifically to a collapsible dish rack for a dishwasher appliance.

BACKGROUND

Dishwashers are used throughout the world to automate and reduce the effort associated with cleaning dishes. Most dishwashers include one or more dish racks to support and secure the individual dishes in a proper position for cleaning and drying. Full size dishwashers typically include a lower dish rack for plates and larger dishes and at least one upper rack for glasses and smaller dishes. Some dishwashers include two upper racks: a top rack for flatware and a middle rack for the glasses and smaller dishes.

SUMMARY

This disclosure provides a collapsible dish rack for a dishwasher appliance.

In a first embodiment, a dishwasher is provided. The dishwasher includes a tub, a first dish rack, and a second dish rack disposed above the first dish rack in the tub. The second dish rack includes a frame configured to couple to and adjust in a vertical position relative to a plurality of mounting rails in the tub. The second dish rack also includes a collapsible portion coupled to the frame and configured to adjust in a vertical position relative to the frame.

In a second embodiment, a dish rack for use with a dishwasher is provided. The dish rack includes a frame configured to couple to and adjust in a vertical position relative to a plurality of mounting rails in the tub. The dish rack also includes a collapsible portion coupled to the frame and configured to adjust in a vertical position relative to the frame.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 24, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged device or system.

Some dishwashers have a height adjustable upper or middle rack that can be moved upward within the dishwasher tub in order to facilitate the placement of tall dishes in the lower rack. While this is sufficient in many cases, sometimes the additional height is inadequate and the upper or middle rack must be removed in order to put taller dishes in the lower rack. This has a number of disadvantages. One is the act of removing and later replacing the rack, which can be difficult. Also, the rack must be stored somewhere which can be inconvenient, given its size. In addition, the removed rack usually includes a rotary spray arm that is not available for use when the rack is removed. This can reduce cleaning performance of the dishwasher.

To address these and other issues, embodiments of this disclosure provide dishwasher racks that are both height adjustable and collapsible. The disclosed dishwasher racks include a collapsible bottom portion that can be adjusted to provide additional vertical space under the rack for tall dishes. It will be understood that embodiments of this disclosure may include any one, more than one, or all of the features described here. In addition, embodiments of this disclosure may additionally or alternatively include other features not listed here. While the disclosed embodiments are described with respect to dishwashers, these embodiments are also applicable in any other suitable devices or systems.

Figure 1C:
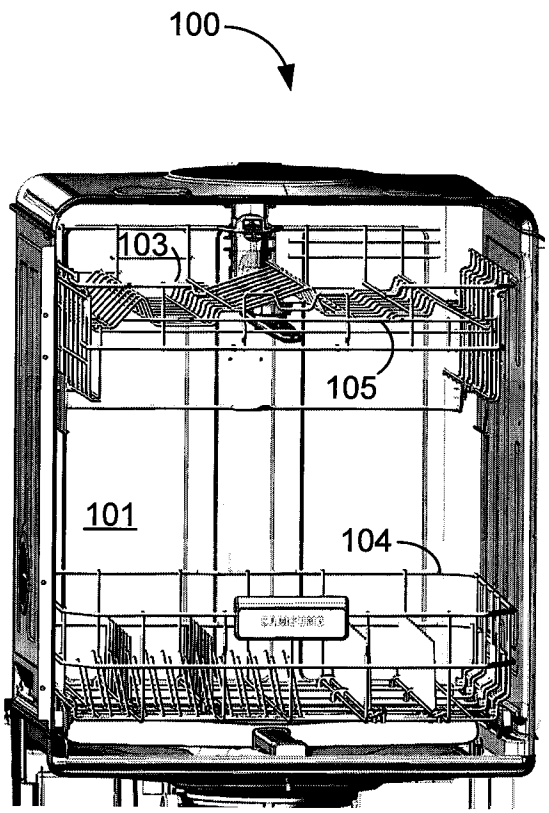
FIGS. 1A through 1C illustrate multiple front perspective views of the interior of an example dishwasher according to this disclosure.
Figure 1B:
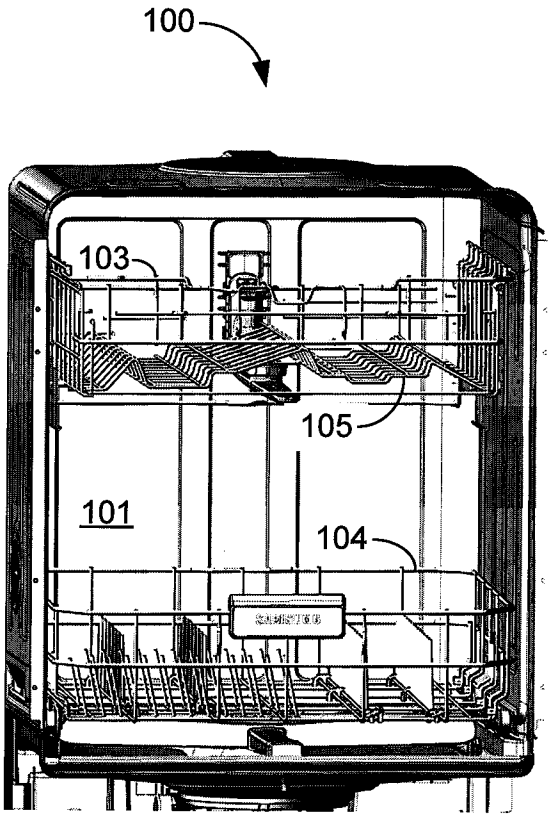
Figure 1A:
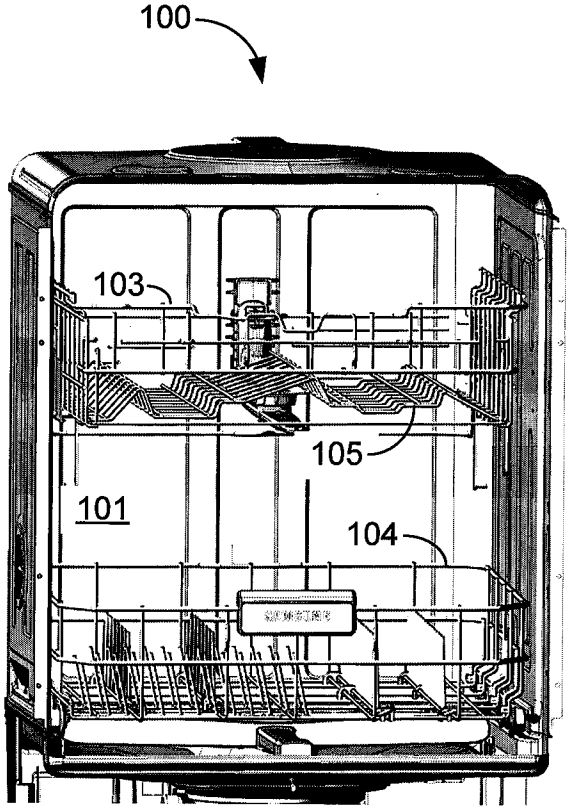

FIGS. 1A through 1C illustrate multiple front perspective views of the interior of a dishwasher 100 according to this disclosure. The embodiment of the dishwasher 100 shown in FIGS. 1A through 1C is for illustration only. Other embodiments of the dishwasher 100 can be used without departing from the scope of this disclosure. Those skilled in the art will recognize that, for simplicity and clarity, some features and components are not explicitly shown in every figure, including those illustrated in connection with other figures. Such features, including those illustrated in other figures, will be understood to be equally applicable to the dishwasher 100. It will be understood that all features illustrated in the figures may be employed in any of the embodiments described. Omission of a feature or component from a particular figure is for purposes of simplicity and clarity, and not meant to imply that the feature or component cannot be employed in the embodiments described in connection with that figure.

As shown in each of FIGS. 1A through 1C, the dishwasher 100 is comprised of a tub 101 that houses multiple dish racks, including a top rack 103 and a bottom rack 104. While the dishwasher 100 in FIGS. 1A through 1C includes two racks, other embodiments may include three racks, such as a top rack, a middle rack, and a bottom rack. Each of the racks 103-104 slides or rolls in and out of the dishwasher 100 on mounting rails or casters, as known in the art. The bottom rack 104 may not be height-adjustable and thus may have a fixed vertical position.

In contrast, the top rack 103 is height-adjustable. FIG. 1A illustrates the top rack 103 in its lower vertical position. FIG. 1B illustrates the top rack 103 in its raised or upper vertical position. In addition to being height-adjustable, the top rack 103 includes a collapsible portion 105 that is collapsible upward to provide additional vertical space in the tub 101 above the bottom rack 104. FIG. 1C illustrates the top rack 103 in the upper vertical position with the collapsible portion 105 completely raised or collapsed. Because the top rack 103 includes a collapsible portion 105, the top rack 103 will now be referred to more generally as the collapsible rack 103. In embodiments with three racks, the collapsible rack 103 may represent the middle rack, which can be height-adjustable and include a collapsible portion.

Figure 2B:
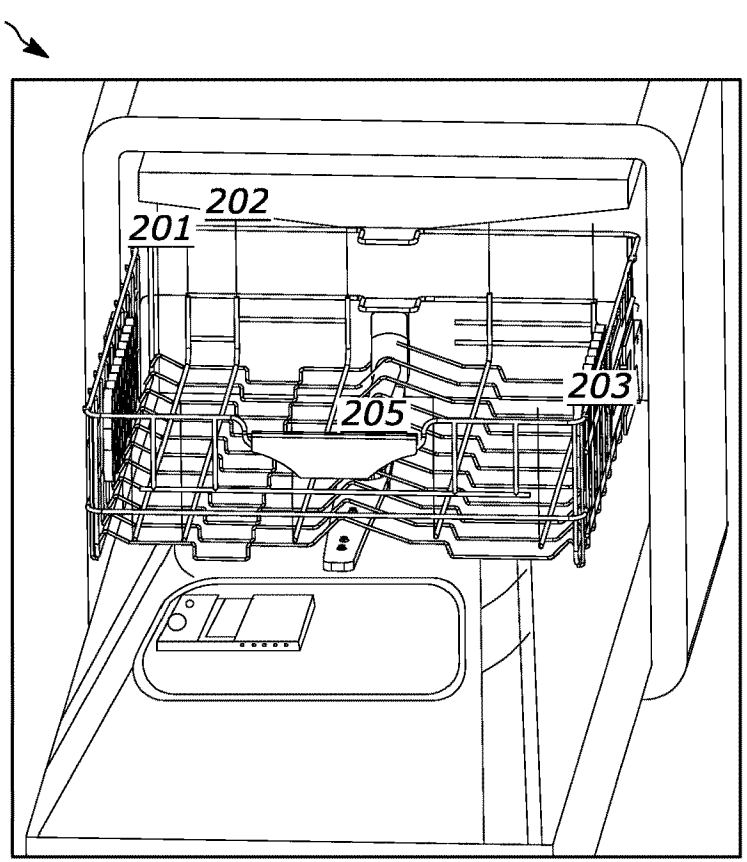
FIGS. 2A and 2B illustrate multiple front perspective views of another example dishwasher according to this disclosure.
Figure 2A:
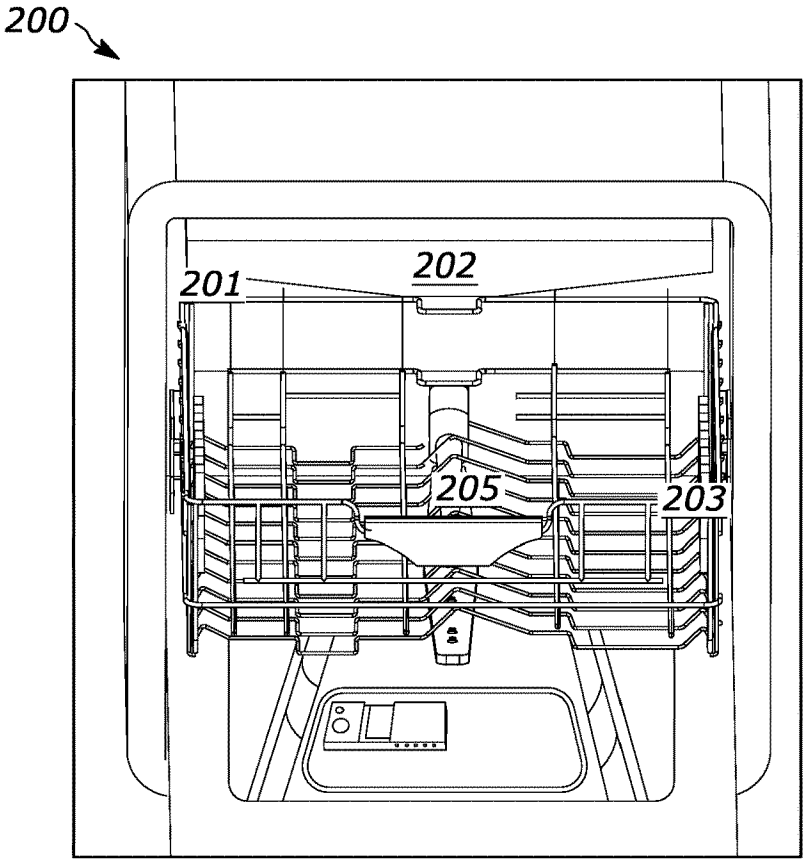
Figure 3:
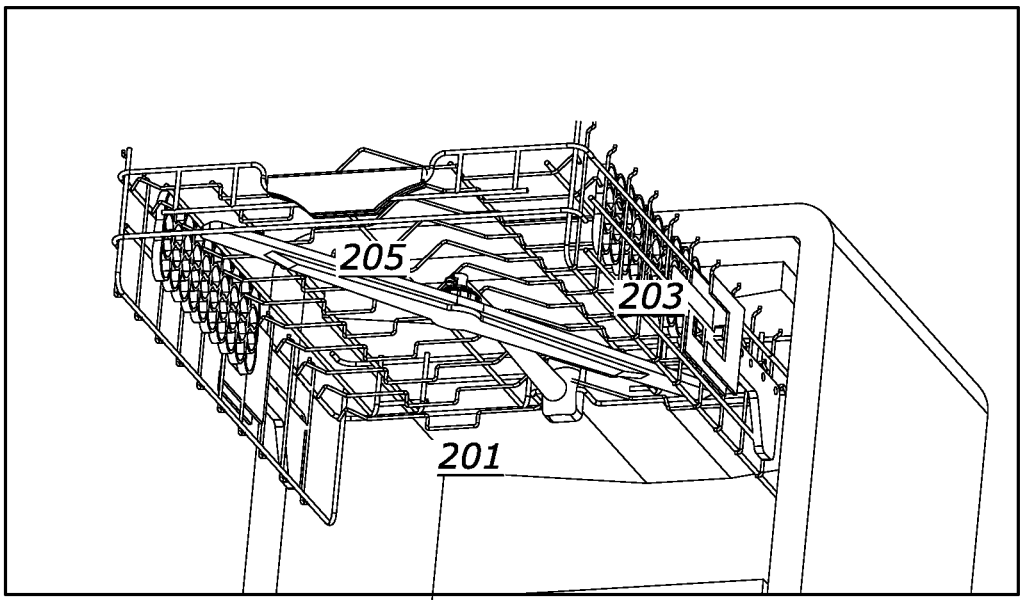
FIG. 3 illustrates a perspective view from below of the dishwasher of FIGS. 2A and 2B with a collapsible portion of a collapsible dish rack in a collapsed position.

FIGS. 2A and 2B illustrate multiple front perspective views of another example dishwasher 200 according to this disclosure. In FIGS. 2A and 2B, the dishwasher 200 includes a top rack 202, a collapsible rack 203 (which is a middle rack in this embodiment), and a bottom rack (hidden in this view). As shown in FIGS. 2A and 2B, the collapsible rack 203 is extended outside the tub 201. In FIG. 2A, the collapsible portion 205 of the collapsible rack 203 is in a lowered vertical position. In FIG. 2B, the collapsible portion 205 of the collapsible rack 203 is in a collapsed position. FIG. 3 illustrates a perspective view from below of the dishwasher 200 with the collapsible rack 203 extended out of the tub 201 and the collapsible portion 205 of the collapsible rack 203 in a collapsed position. These positions are shown in greater detail in later figures.

Figure 4:
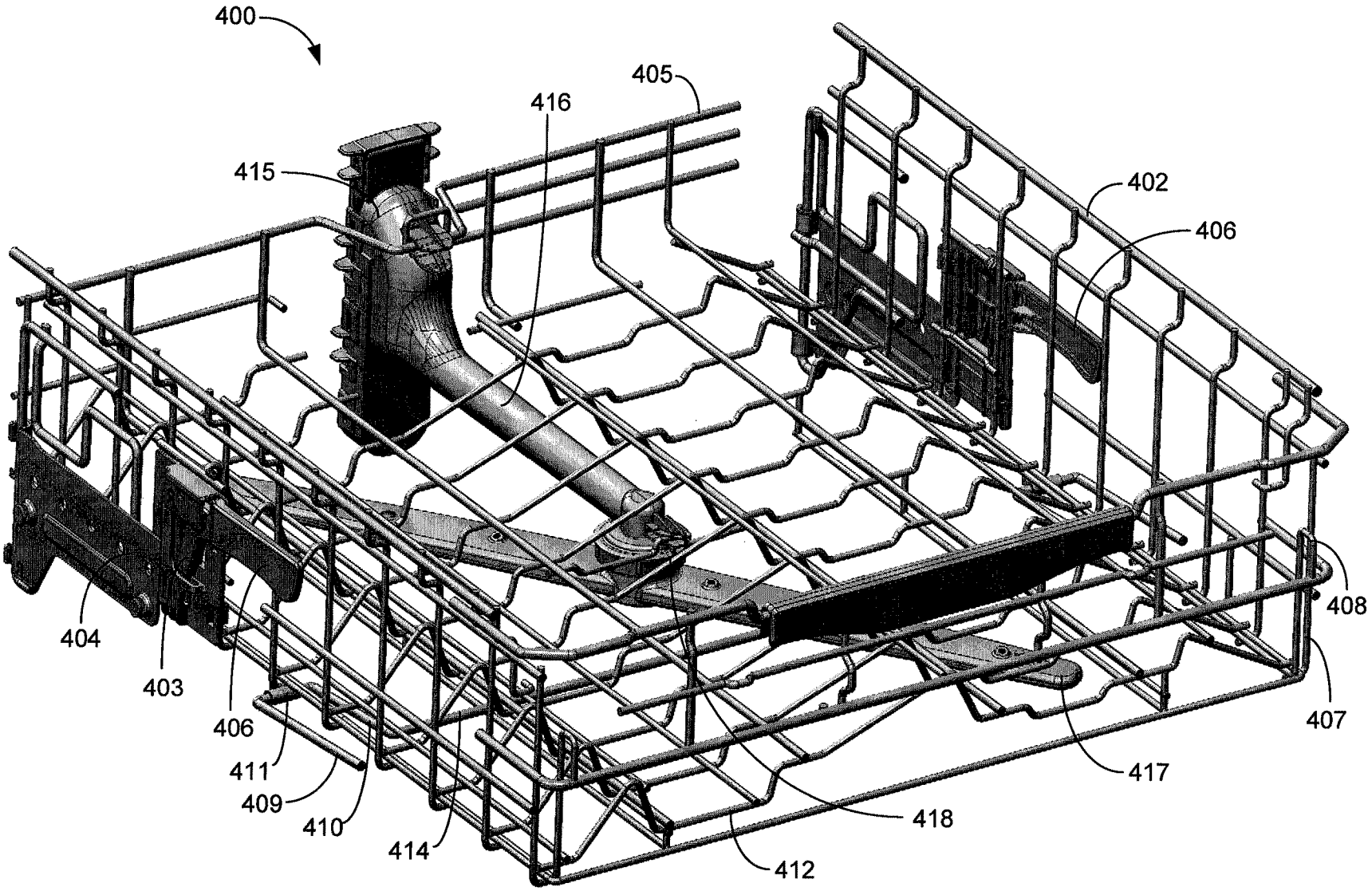
FIG. 4 illustrates a front perspective view of a collapsible dish rack according to this disclosure.

FIG. 4 illustrates a front perspective view of a collapsible rack according to this disclosure. The collapsible rack 400 may represent (or be represented by) the collapsible rack 103 of FIG. 1 or the collapsible rack 203 of FIG. 2. In FIG. 4, the collapsible rack 400 has been removed from the dishwasher to promote clarity of some of the features. The collapsible rack 400 including a rigid outside frame 402 and a collapsible portion 405. The outside frame 402 includes mounting elements 404 positioned on each side of the outside frame 402 to attach the collapsible rack 400 to the dishwasher rail 206 (shown in FIG. 3). The collapsible rack 400 also includes an adjustment mechanism 403 and a lever 406 disposed on each side of the collapsible rack 400 to adjust the vertical position of the collapsible rack 400 in the dishwasher tub 101. In one aspect of operation, the levers 406 may be actuated, such as by turning the levers 406 through an arc (e.g., a 90 degree arc or another suitable value up to and including 360 degrees of arc rotation). Actuation of the levers 406 actuates the adjustment mechanisms 403 which raise or lower the collapsible rack 400 between different vertical positions. The adjustment mechanisms 403 may include a cam, a slide, other suitable positioning components, or a combination of these.

A linear rail 407 on the outside frame 402 guides movement of the collapsible portion 405 up and down with respect to the remaining portions of the collapsible rack 400. One or more hard stops 408 may be used to limit the collapsing movement of the collapsible portion 405. The collapsing movement of the collapsible portion 405 is controlled by actuation of a lever 409 that is connected to a crank 410 and rotating bearings 411. Depending on the embodiment, the lever 409, crank 410, and rotating bearings 411 may be disposed on one side of the collapsible rack 400, on both sides of the collapsible rack 400, on a bottom surface of the collapsible rack 400, or in any other suitable position.

The interior of the outside frame 402 can include resting elements to support the collapsible portion 405 in a lower (i.e., uncollapsed) position. The collapsible portion 405 includes a frame 412. The frame 412 can be configured to fit within the outside frame 402. When the collapsible portion 405 is in the lower position, the frame 412 of the collapsible portion 405 can rest on the resting elements provided at the outside frame 402: The side of the frame 412 can include one or more linear slides, allowing the frame 412 to slide along the linear rail 407 of the outside frame 402.

A bottom portion of the frame 412 includes one or more rails 414 and one or more hard stops 418 that limit movement of the frame 412. A water supply connection 415 is mounted at a rear portion of the frame 412. The water supply connection 415 receives water from the dishwasher and provides the water to a feed pipe 416 and washing arm 417, which are mounted below the frame 412. Although not shown in FIG. 4, various tines can be positioned across the collapsible rack 400 to hold dishes in place during a wash cycle, as known in the art.

The position of the collapsible portion 405 can be adjusted using the lever 409. In one aspect of operation, the lever 409 may be actuated, such as by rotating the lever 409 through an arc alongside the outside frame 402. Movement of the lever 409 causes movement of the crank 410, which lifts the rail 414 of the frame 412, causing the front of the frame 412 to move up. The slides of the frame 412 move up along the rail 407 until the slides reach the hard stop 408. The crank 410 can continue to lift the frame 412 until movement is stopped at the hard stops 418.

As described above, actuation of the levers 406 on both sides of the collapsible rack 400 raises or lowers the collapsible rack 400 between at least two different vertical positions. Similarly, using the levers 409 on the sides of the collapsible rack 400, the collapsible portion 405 is adjustable to at least two vertical positions relative to the collapsible rack 400. Accordingly, the total number of vertical positions of the collapsible portion 405 is at least four. In some embodiments, a user can actuate only one of the levers 409. This causes only one side of the collapsible portion 405 to adjust in vertical position relative to the collapsible rack 400. As a result, the collapsible portion 405 is inclined or tilted slightly to the left or to the right, depending on which lever 409 is rotated.

The water supply connection 415 is fixedly mounted to the frame 412. Thus, the water supply connection 415, the feed pipe 416, and the washing arm 417 move vertically in tandem with movement of the collapsible portion 405. That is, as the collapsible portion 405 is adjusted up or down with respect to the collapsible rack 400, the water supply connection 415, the feed pipe 416, and the washing arm 417 adjust up or down by the same amount. The water supply connection 415 aligns with a water feed connection point (such as shown in FIG. 6A) on the rear wall of the dishwasher tub 101. During operation of dishwasher 100, water from the water feed connection point is provided to the water supply connection 415, and then to the feed pipe 416 and washing arm 417.

Figure 5:
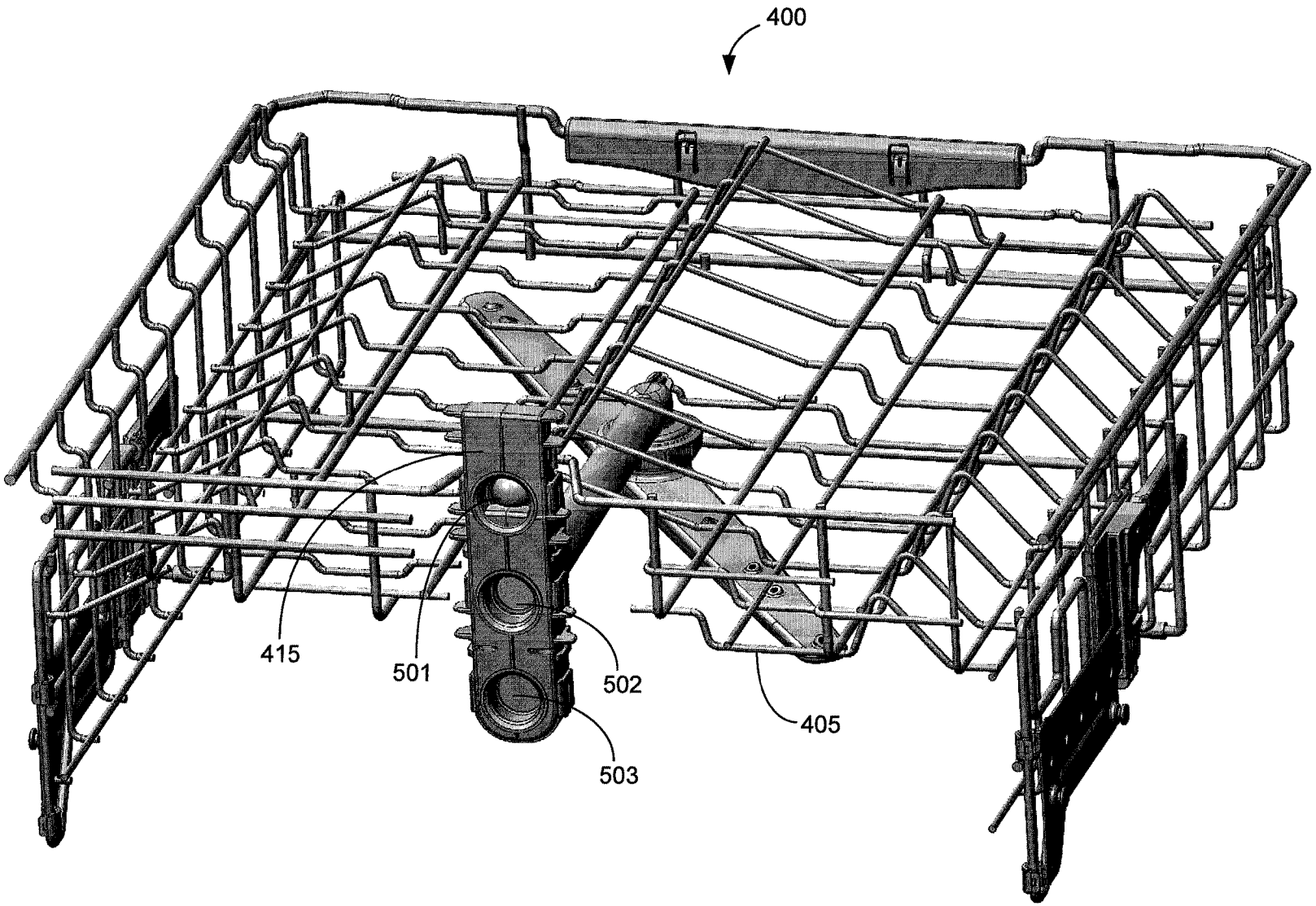
FIG. 5 illustrates a rear perspective view of the collapsible dish rack of FIG. 4 according to this disclosure.

FIG. 5 illustrates a rear perspective view of the collapsible rack 400 according to this disclosure. In FIG. 5, multiple connection points 501-503 for the water supply connection 415 can be seen. Because the water feed connection point on the rear wall of the dishwasher tub has a static position, and the collapsible rack 400 and the collapsible portion 405 are configurable in different vertical positions, the water supply connection 415 includes the multiple connection points 501-503 to align with the static water feed connection point. As shown in FIG. 5, the connection points include a first connection point 501 that corresponds to the collapsible rack 400 in the lower position and the collapsible portion 405 in the uncollapsed position, a second connection point 502 that corresponds to the collapsible rack 400 in the upper position and the collapsible portion 405 in the uncollapsed position, and a third connection point 503 that corresponds to the collapsible rack 400 in the upper position and the collapsible portion 405 in the collapsed position. In some embodiments, the second connection point 502 can also be used when the collapsible rack 400 is in the lower position and the collapsible portion 405 is in the collapsed position. In other embodiments, a fourth connection point (not shown) in the water supply connection 415 could be used for that configuration (the collapsible rack 400 in the lower position and the collapsible portion 405 in the collapsed position). In some embodiments, a flapper valve (or ball valve or another suitable one-way valve) (not shown) associated with each of the connection points 501-503 can close and seal whichever connection points 501-503 are not currently aligned with the water feed connection point.

While FIGS. 4 and 5 illustrate one example of the collapsible rack 400, various changes may be made to FIGS. 4 and 5. For example, while the collapsible portion 405 is described as collapsing upward, in some embodiments, the collapsible portion 405 could be configured to adjust downward, e.g., by actuation of the levers 409 in the opposite direction. Downward movement of the collapsible portion 405 can be helpful when additional vertical space is desired in the collapsible rack 400. As another example, in some embodiments, adjustment mechanisms, such as levers, could be used to incline or tilt a front portion of the collapsible portion 405, a rear portion of the collapsible portion 405, or both. As a further example, in some embodiments, the collapsible portion 405 could include a left collapsible portion and a right collapsible portion, where each collapsible portion is separately actuated by one of the levers 409.

Figure 6B:
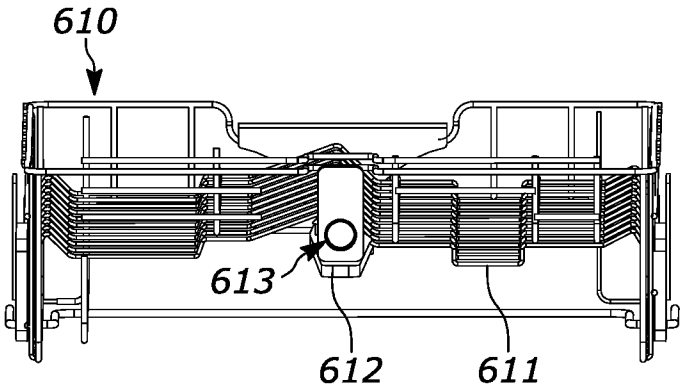
FIG. 6B illustrates a corresponding water supply connection on a collapsible rack according to this disclosure.
Figure 6A:
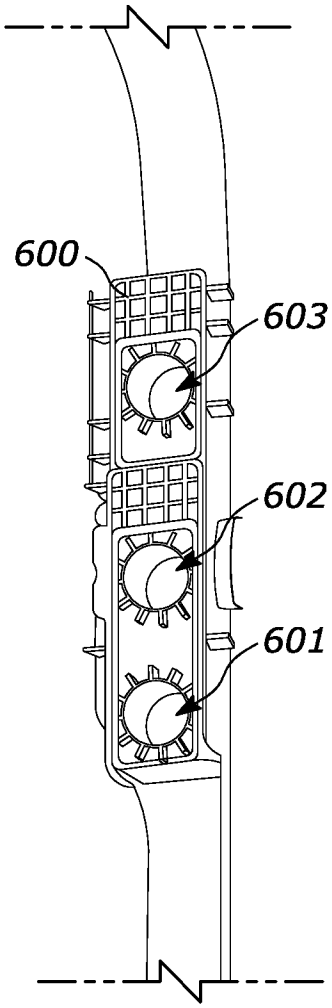
FIG. 6A illustrates an example water feed connection point on the rear wall of a dishwasher tub according to this disclosure.

FIG. 6A illustrates an example water feed connection point on the rear wall of a dishwasher tub and FIG. 6B illustrates a corresponding water supply connection on a collapsible rack according to this disclosure. In FIG. 6B, a collapsible rack 610 is similar to the collapsible racks 103, 203 and includes many of the same or similar components, including a collapsible portion 611. In contrast to the embodiment of FIG. 5, in which the water feed connection point is a single point and the collapsible rack 400 includes three or more connection points 501-503, FIGS. 6A and 6B shows a different configuration for the water connection.

As shown FIG. 6A, the water feed connection point 600 includes three connection points 601-603. FIG. 6B shows the collapsible rack 610, which includes a water supply connection 612 with a single connection point 613. Instead of the water supply connection 612 having multiple connection points, the water feed connection point 600 on the rear wall of the dishwasher has multiple connection points 601-603. As the vertical positions of the collapsible rack 610 and the collapsible portion 611 are adjusted, the vertical position of the connection point 613 also changes. Depending on its vertical position, the connection point 613 aligns with one of the connection points 601-603. For example, when the collapsible rack 610 is in the lower position and the collapsible portion 611 is in the uncollapsed position, the connection point 613 aligns with the connection point 601. When the collapsible rack 610 is in the upper position and the collapsible portion 611 is in the uncollapsed position, the connection point 613 aligns with the connection point 602. When the collapsible rack 610 is in the upper position and the collapsible portion 611 is in the collapsed position, the connection point 613 aligns with the connection point 603. Depending on the embodiment, the second connection point 602 can also be used when the collapsible rack 610 is in the lower position and the collapsible portion 611 is in the collapsed position, or a fourth connection point (not shown) in the water feed connection point 600 could be used for that configuration (the collapsible rack 610 in the lower position and the collapsible portion 611 in the collapsed position). In some embodiments, a flapper valve (or ball valve or another suitable one-way valve) (not shown) associated with each of the connection points 601-603 can close and seal whichever connection points 601-603 are not currently aligned with the connection point 613.

FIGS. 7 through 20 illustrate different views of the collapsible rack 610 from various directions, in both collapsed (raised) and lowered positions, to depict features of the collapsible rack 610 in greater detail.

Figure 7:
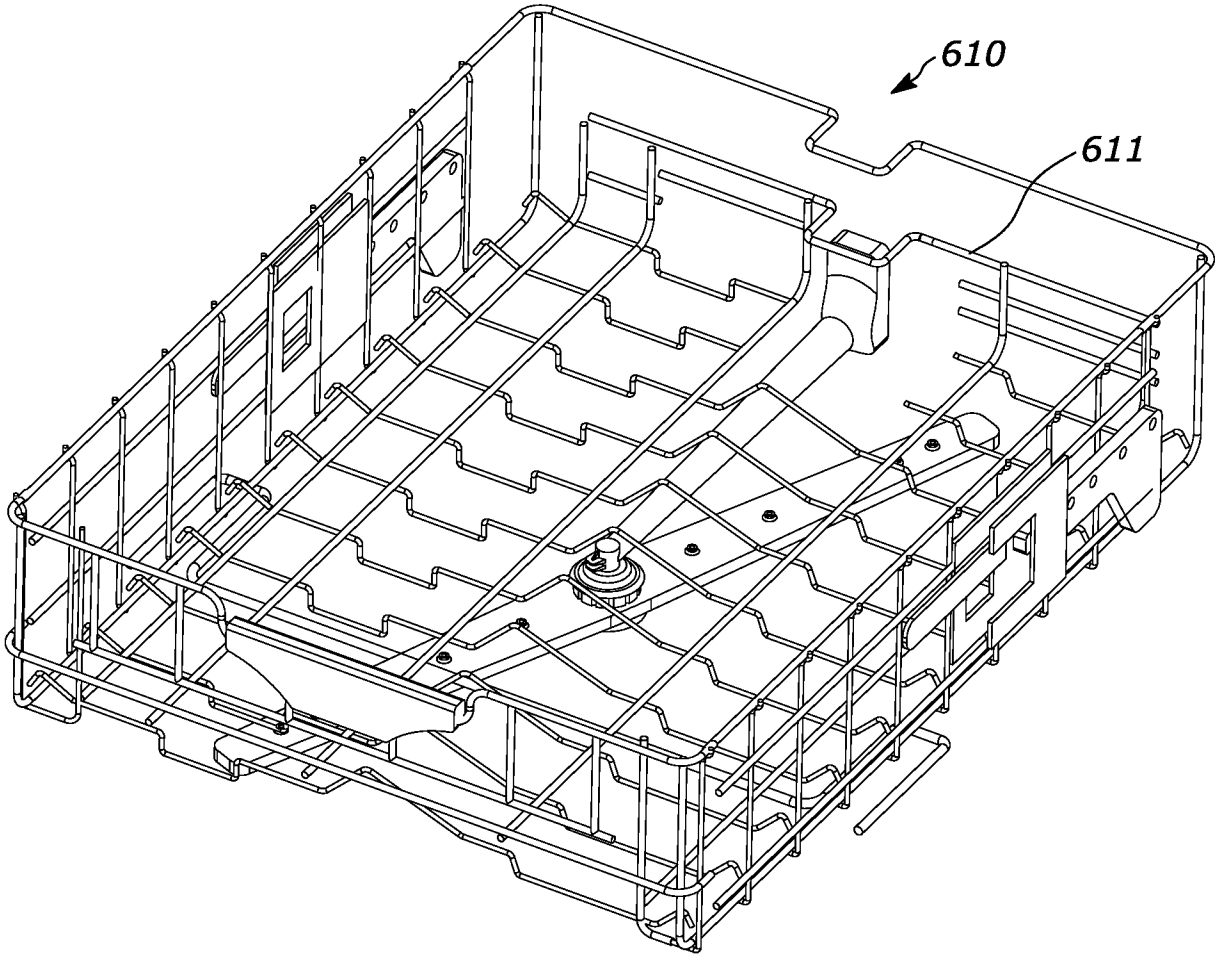
FIGS. 7 through 20 illustrate different views of the collapsible dish rack of FIG. 6B from various directions, in both collapsed (raised) and lowered positions.
Figure 8:
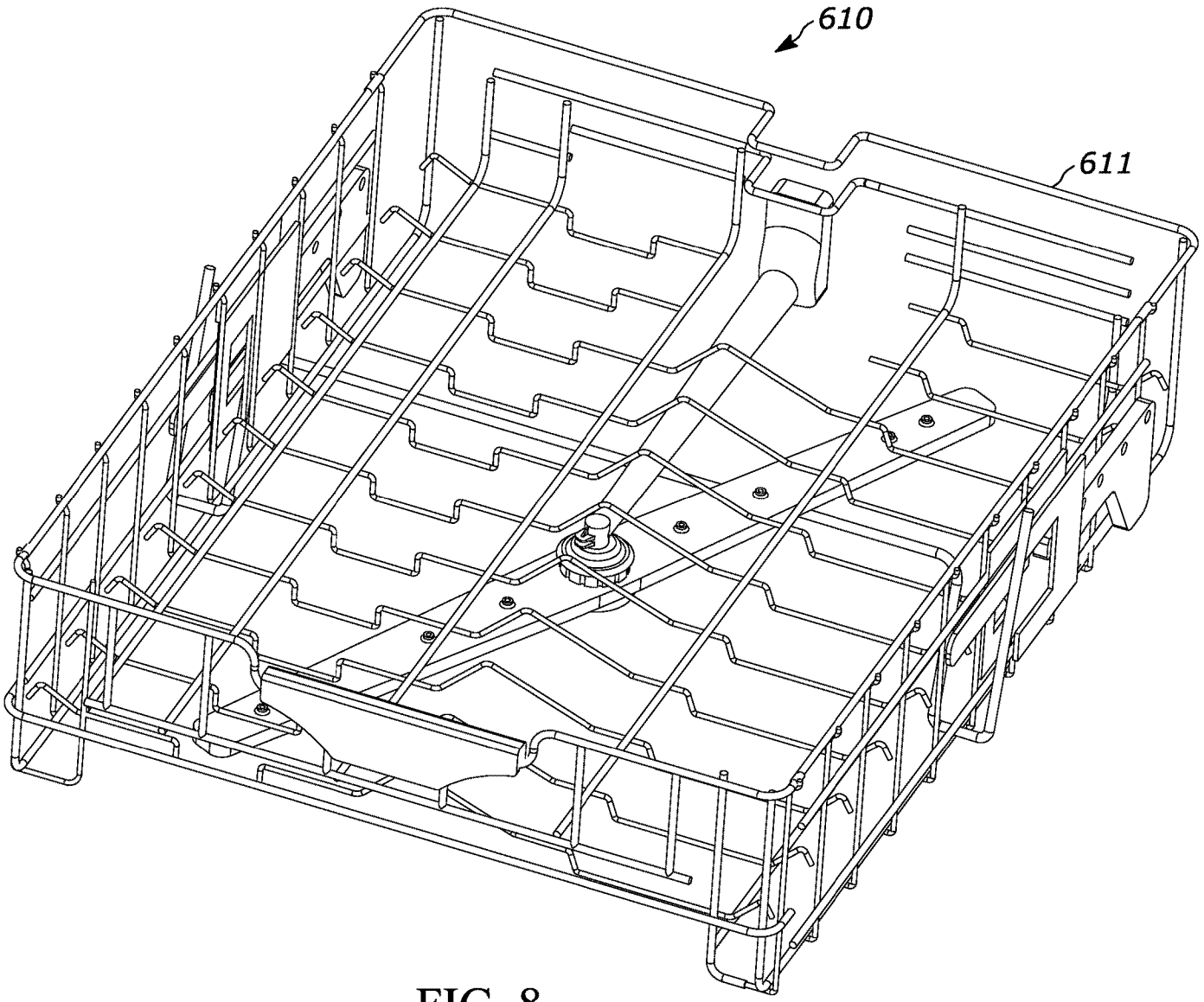

FIG. 7 illustrates a front perspective view of the collapsible rack 610 with the collapsible portion 611 in the lower position. FIG. 8 illustrates a front perspective view of the collapsible rack 610 with the collapsible portion 611 in the collapsed position.

Figure 9:
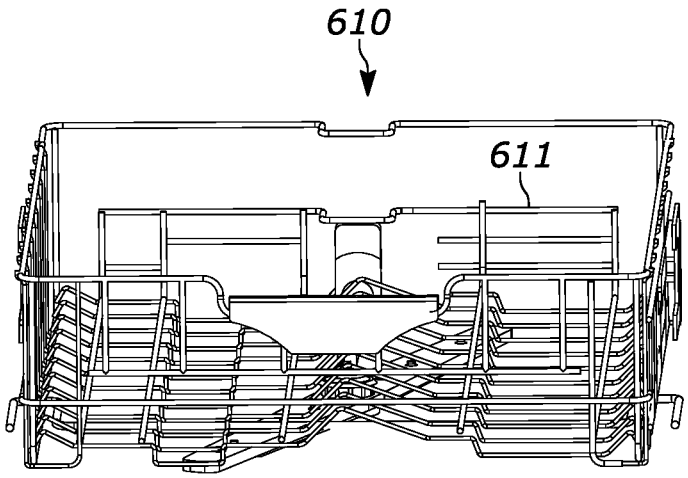
Figure 10:
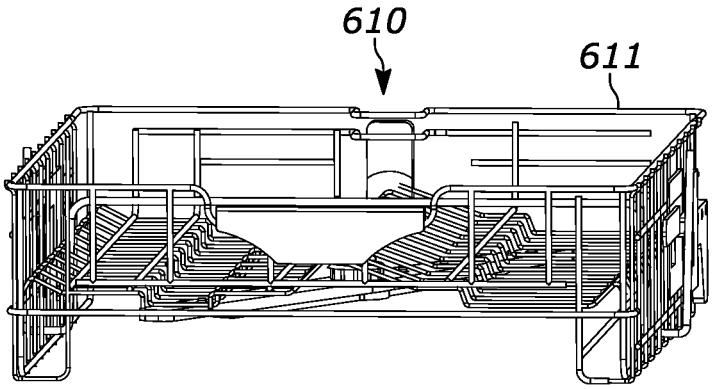

FIG. 9 illustrates a front view of the collapsible rack 610 with the collapsible portion 611 in the lower position. FIG. 10 illustrates a front view of the collapsible rack 610 with the collapsible portion 611 in the collapsed position.

Figure 11:
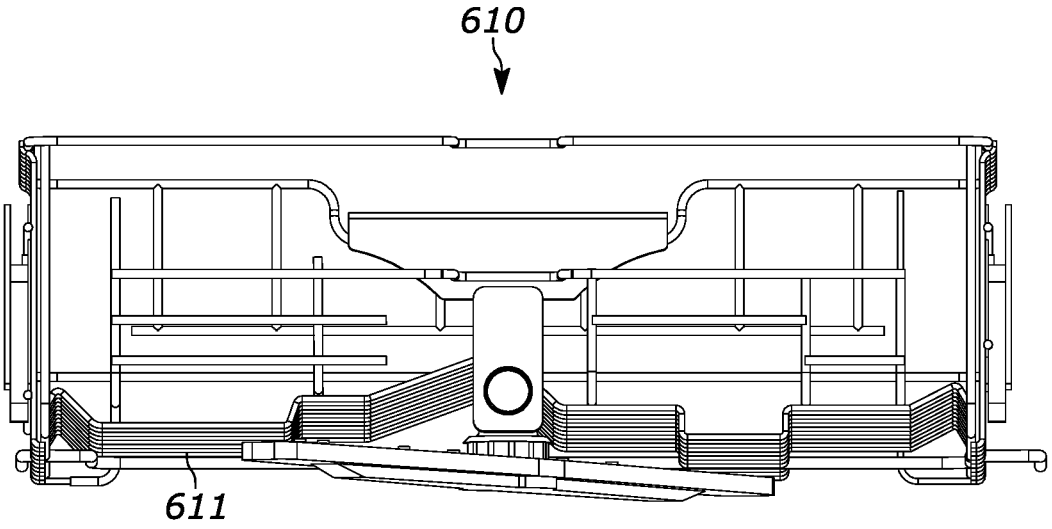
Figure 12:
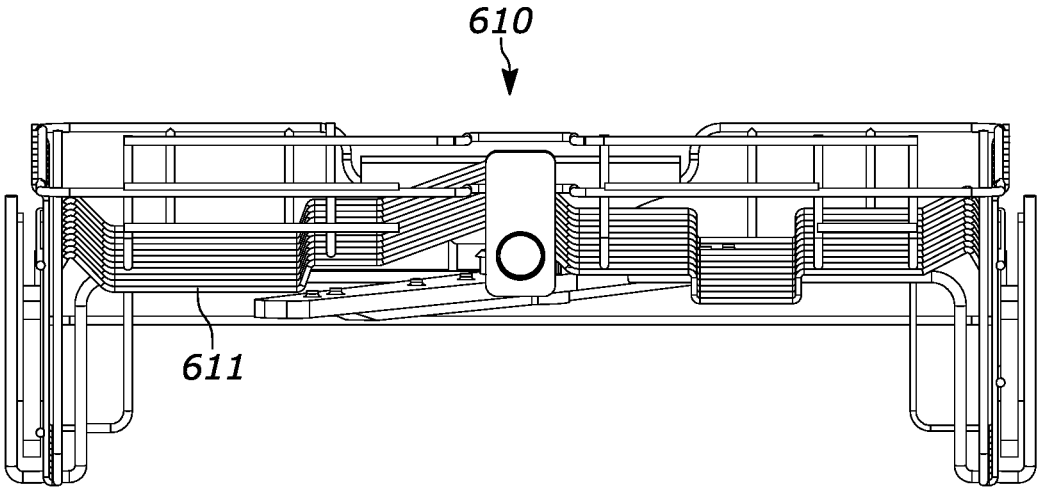

FIG. 11 illustrates a rear view of the collapsible rack 610 with the collapsible portion 611 in the lower position. FIG.

12 illustrates a rear view of the collapsible rack 610 with the collapsible portion 611 in the collapsed position.

Figure 13:
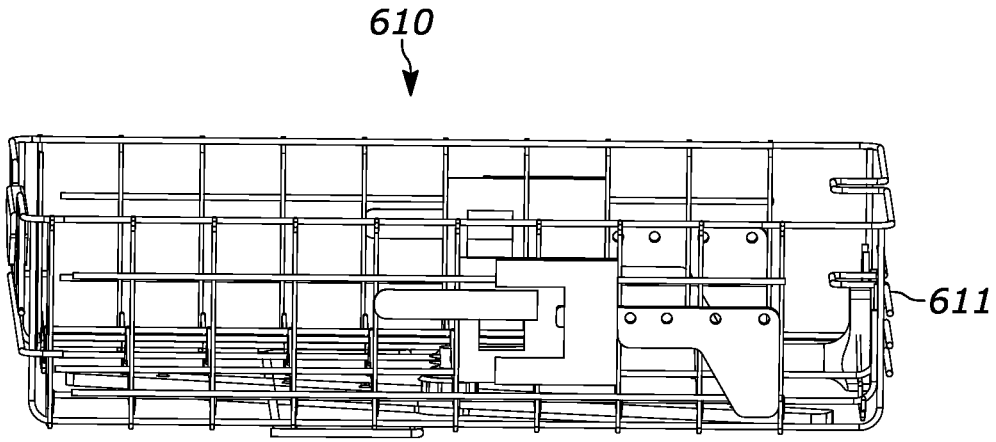
Figure 14:
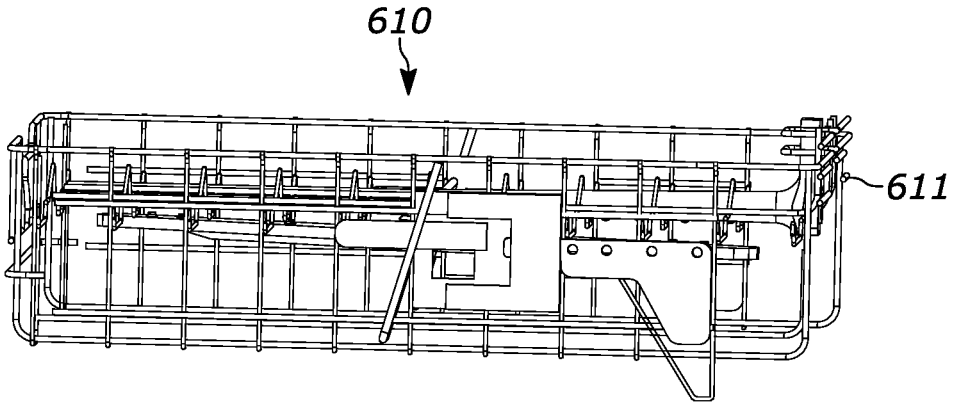

FIG. 13 illustrates a side view of the collapsible rack 610 with the collapsible portion 611 in the lower position. FIG. 14 illustrates a side view of the collapsible rack 610 with the collapsible portion 611 in the collapsed position.

Figure 15:
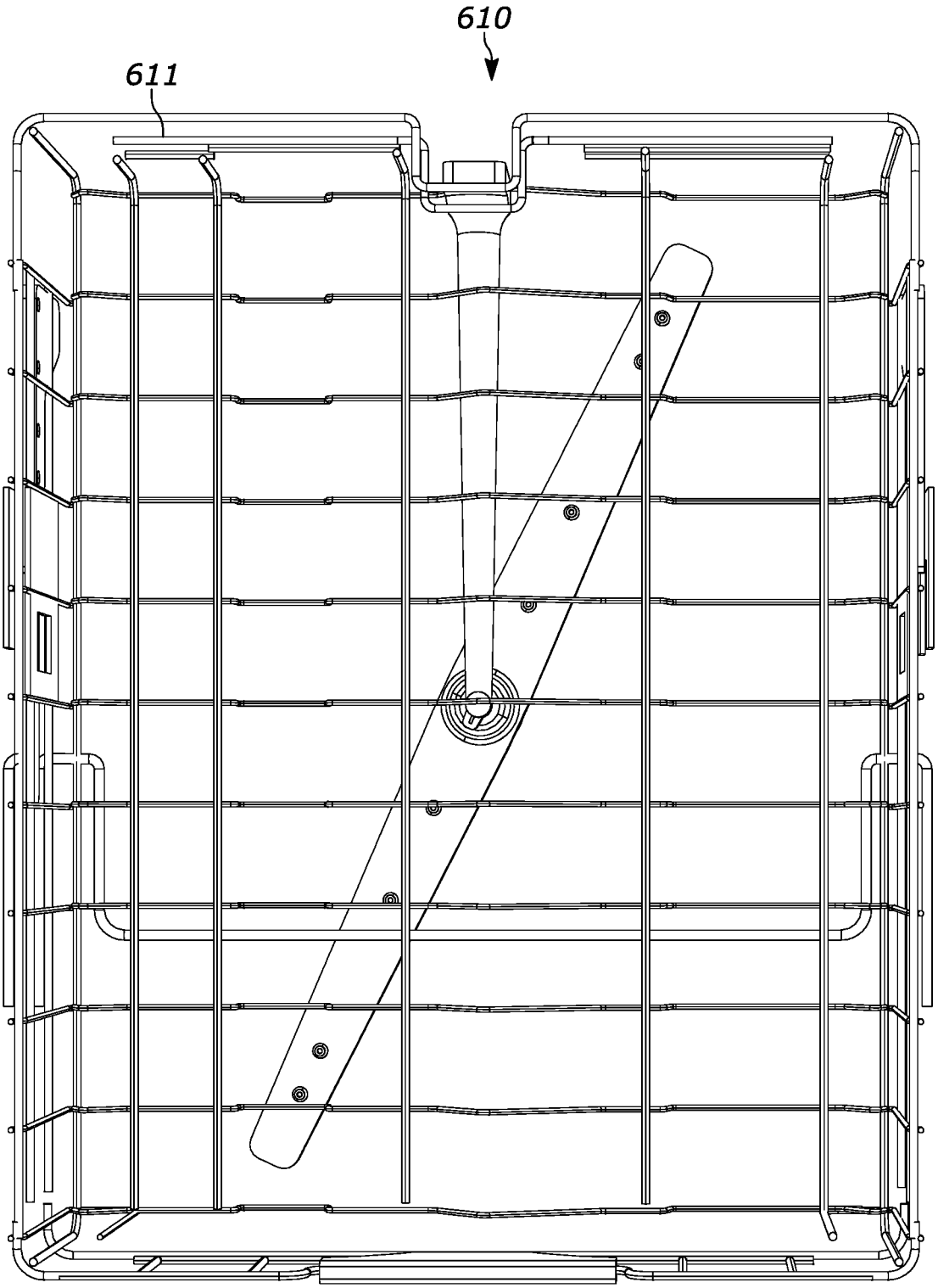
Figure 16:
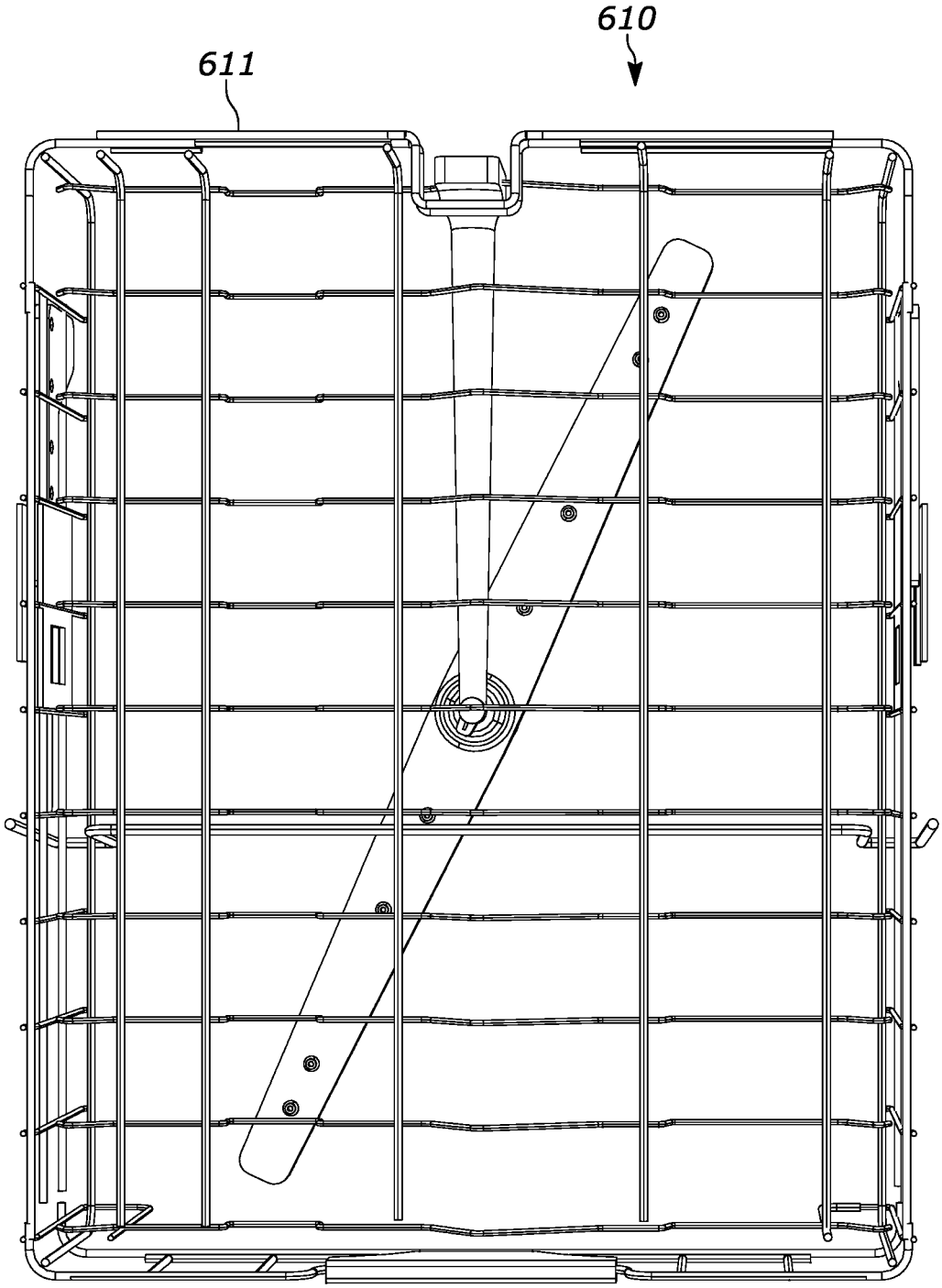

FIG. 15 illustrates a top view of the collapsible rack 610 with the collapsible portion 611 in the lower position. FIG. 16 illustrates a top view of the collapsible rack 610 with the collapsible portion 611 in the collapsed position.

Figure 17:
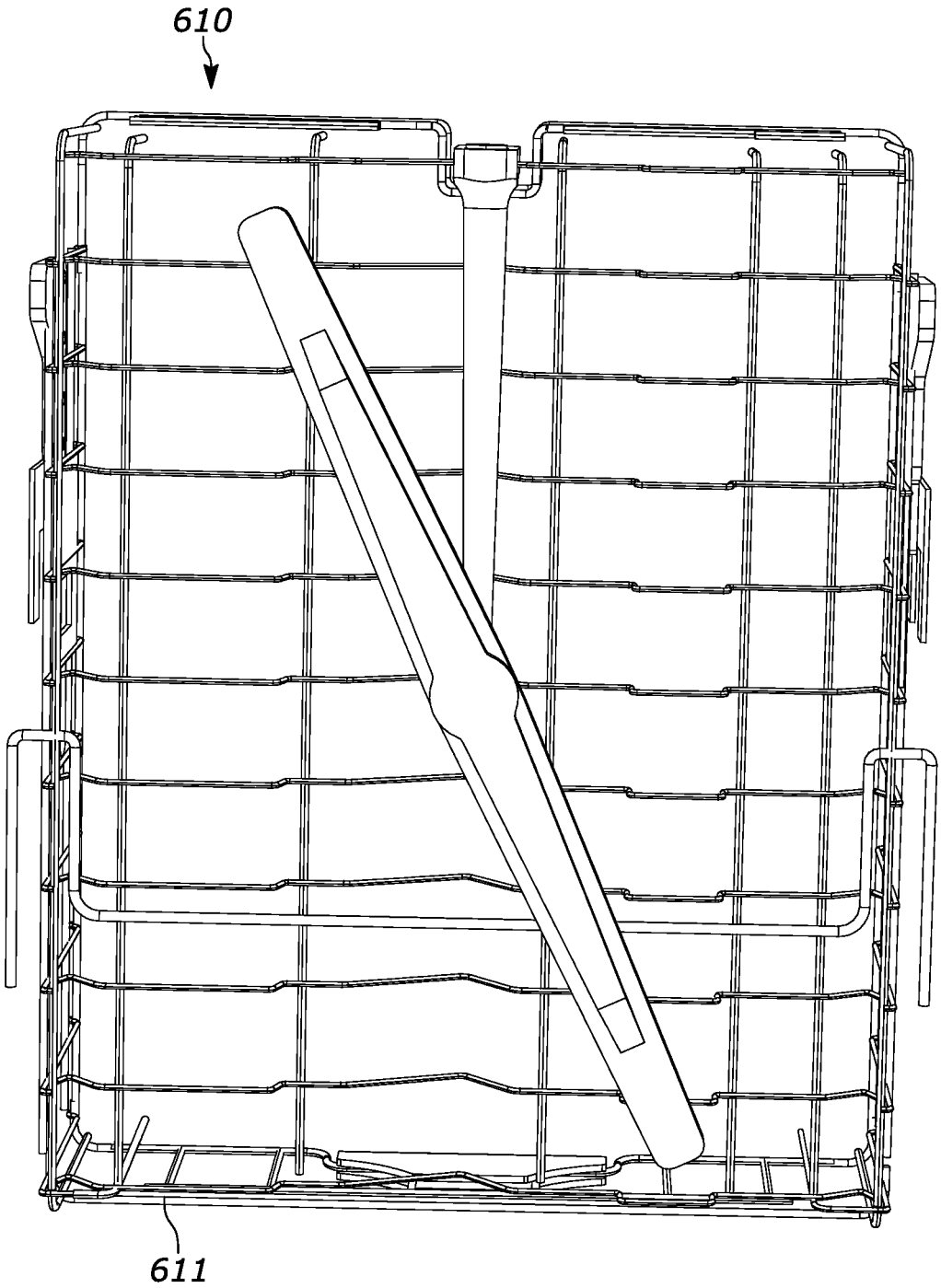
Figure 18:
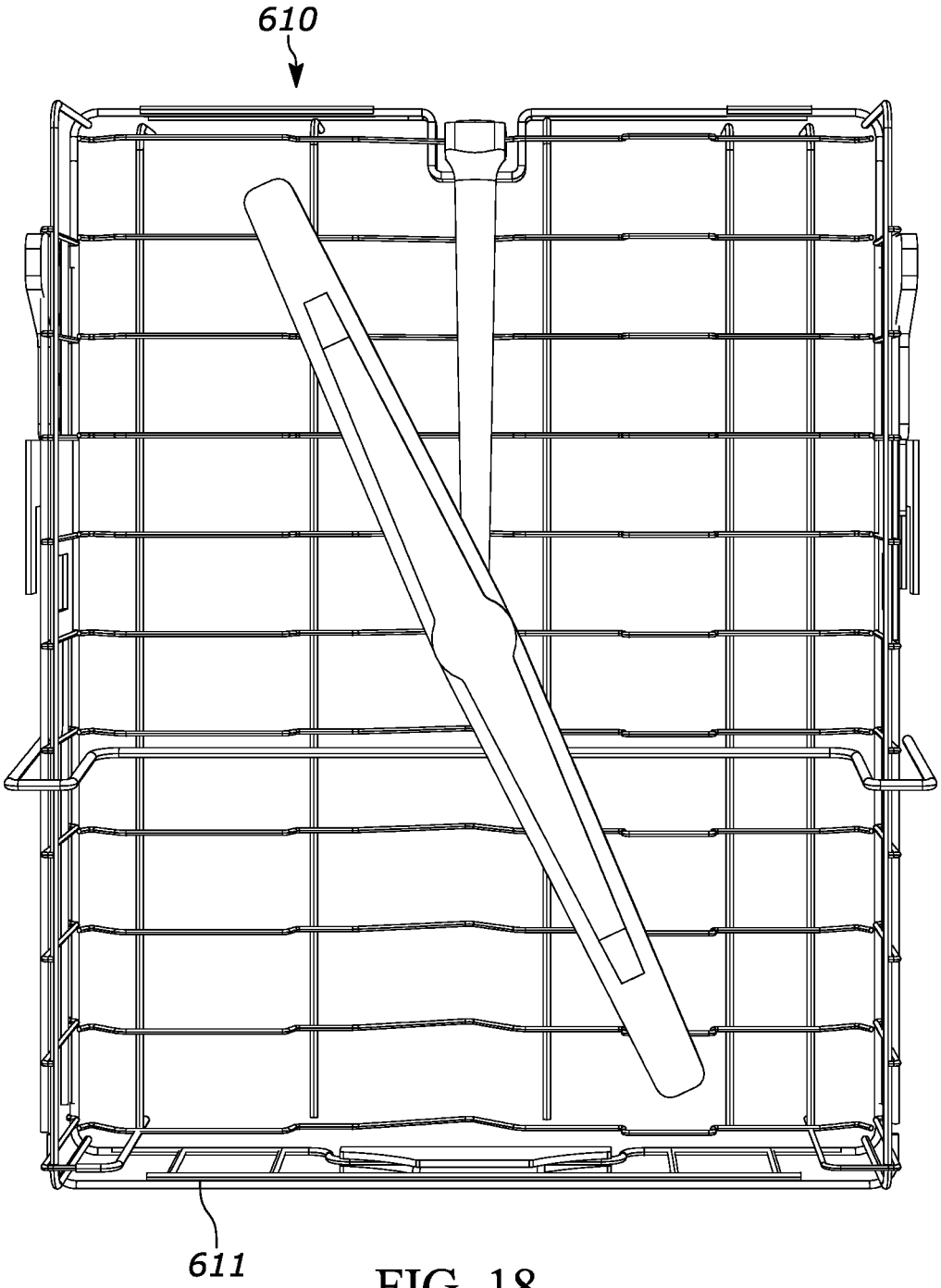

FIG. 17 illustrates a bottom view of the collapsible rack 610 with the collapsible portion 611 in the lower position. FIG. 18 illustrates a bottom view of the collapsible rack 610 with the collapsible portion 611 in the collapsed position.

Figure 19:
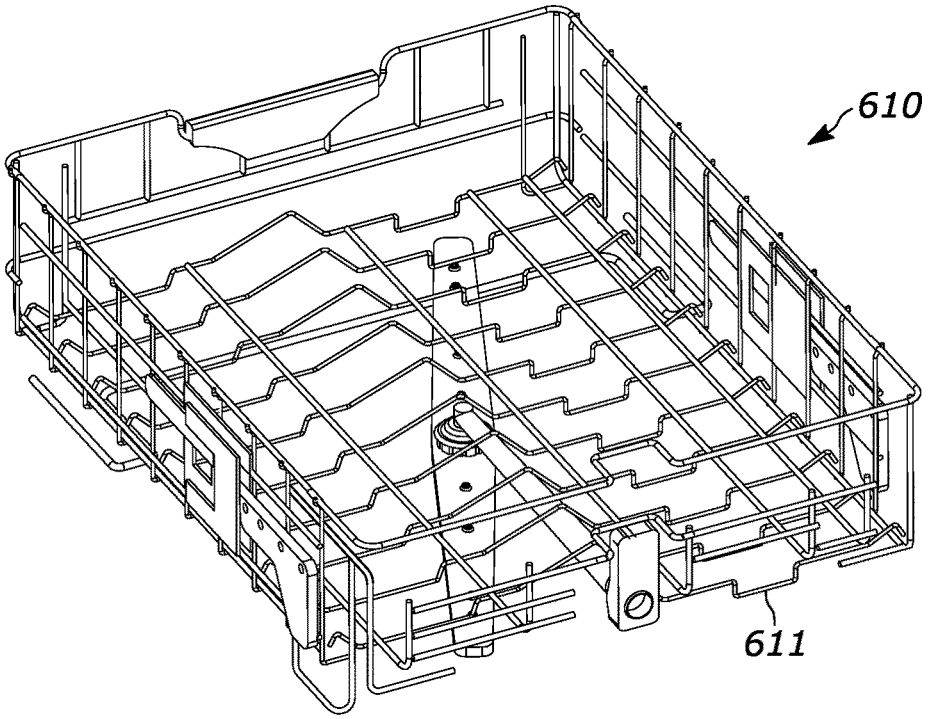
Figure 20:
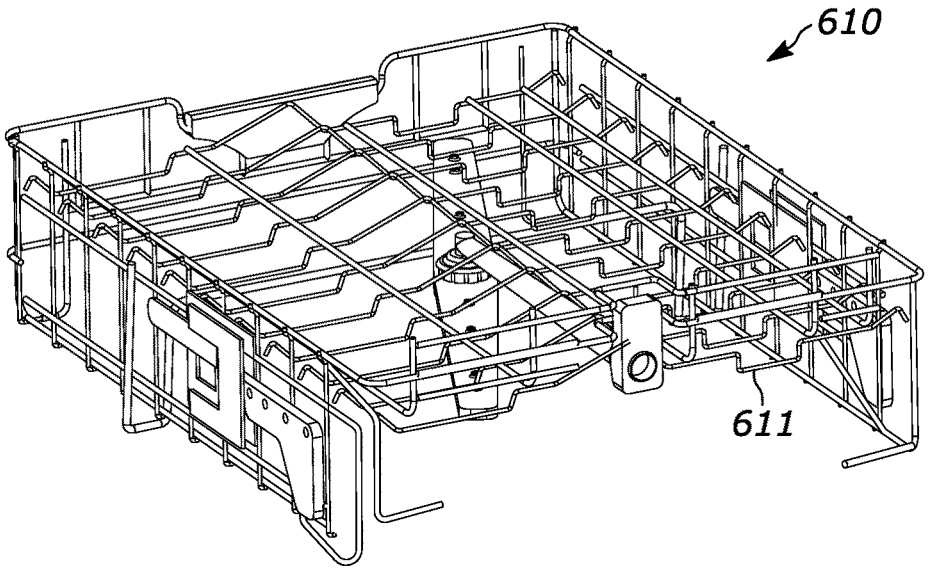

FIG. 19 illustrates a rear perspective view of the collapsible rack 610 with the collapsible portion 611 in the lower position. FIG. 20 illustrates a rear perspective view of the collapsible rack 610 with the collapsible portion 611 in the collapsed position.

Figure 21:
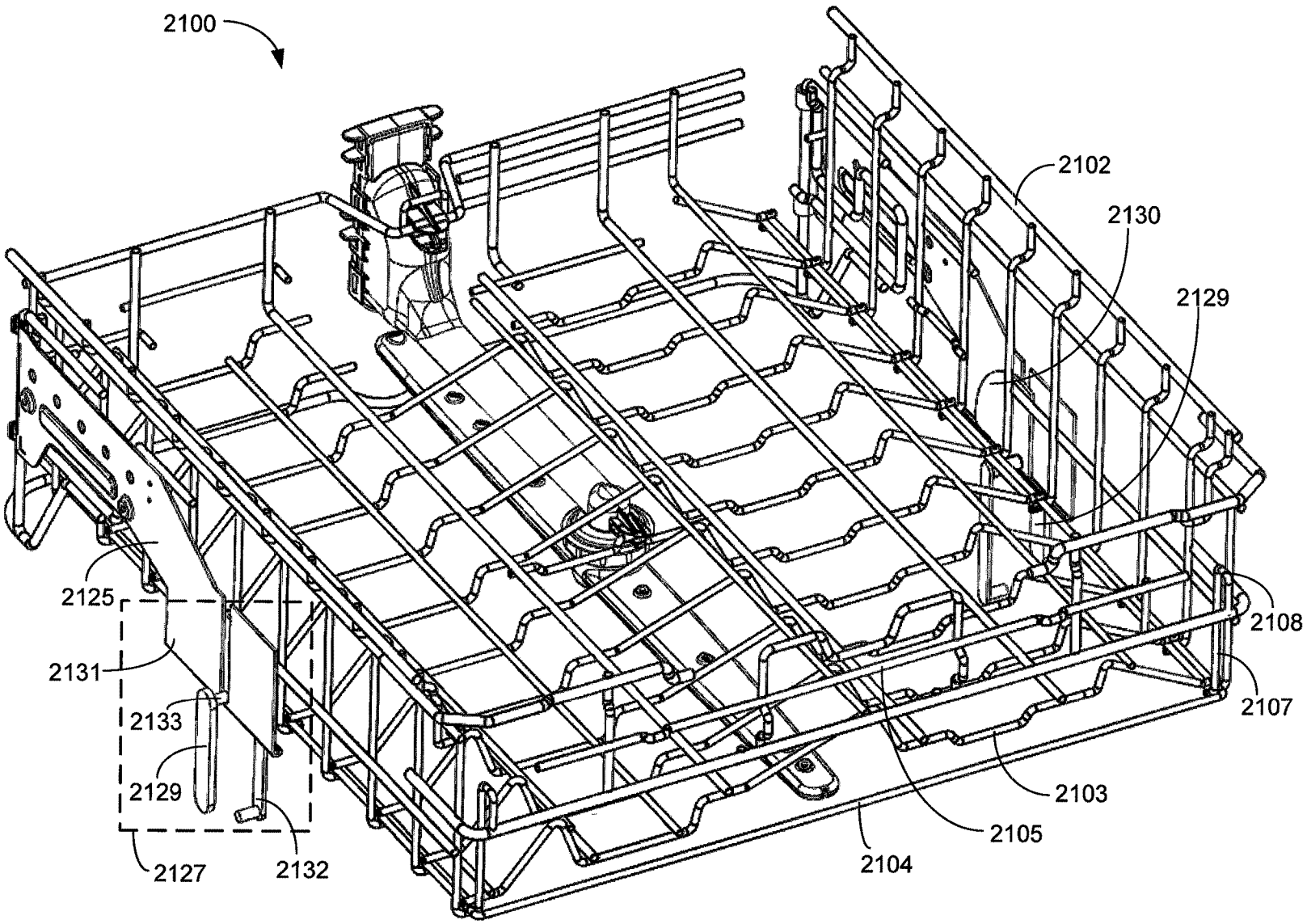
FIGS. 21 through 23 illustrate a collapsible dish rack according to another embodiment of this disclosure.
Figure 22:
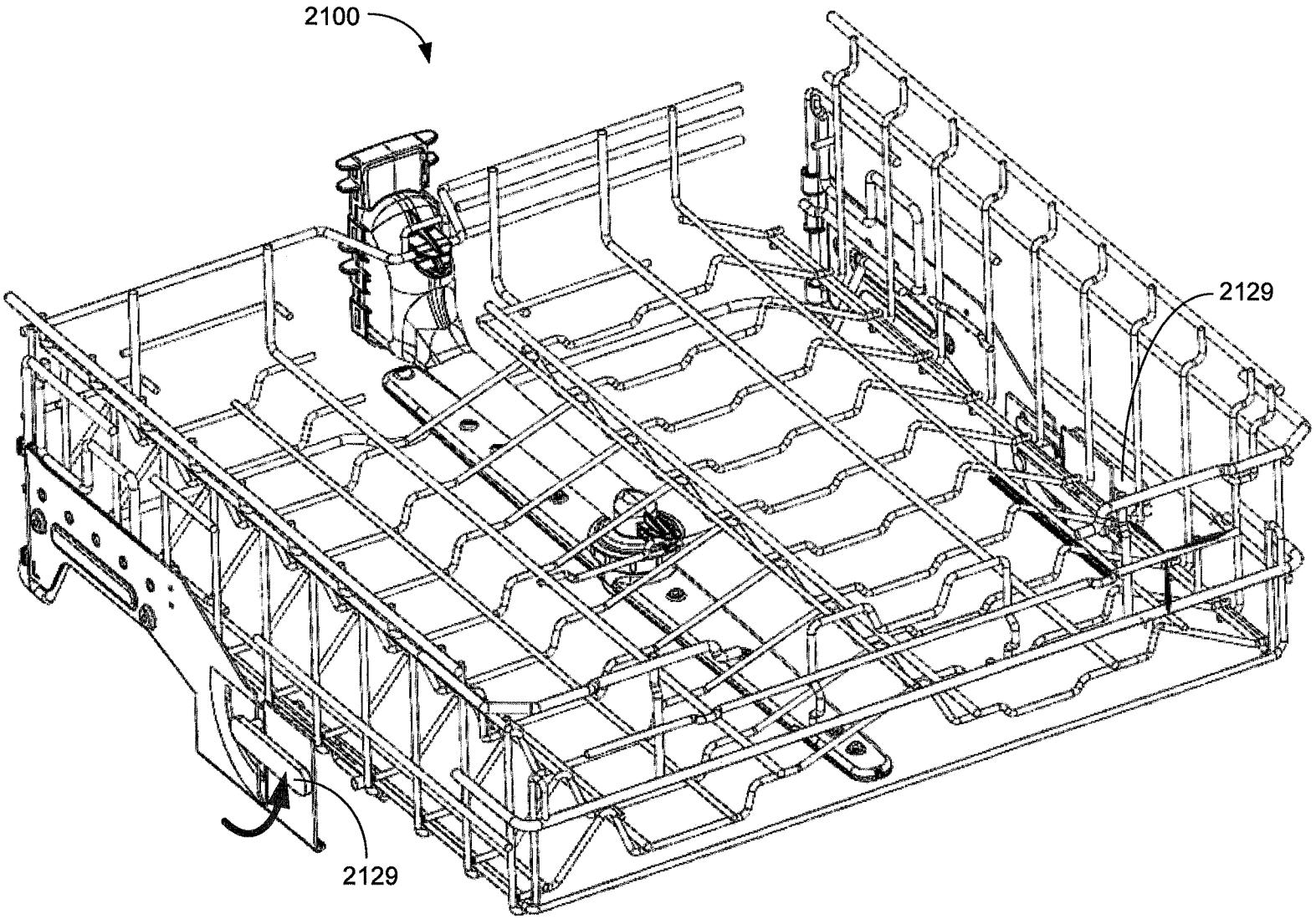
Figure 23:
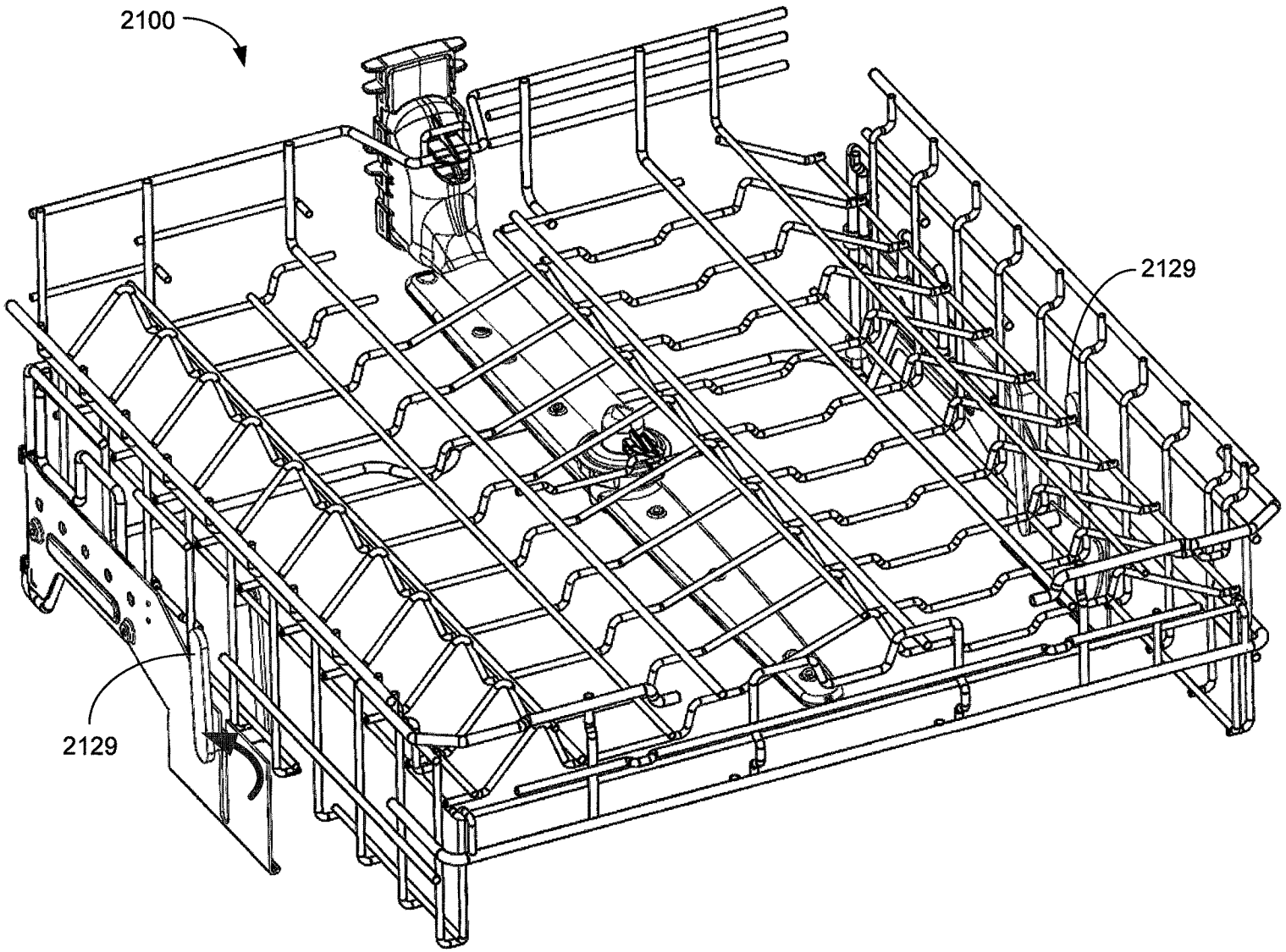

FIGS. 21 through 23 illustrate a collapsible dishwasher rack 2100 according to another embodiment of this disclosure. The embodiment of the collapsible rack 2100 shown in FIGS. 21 through 23 is for illustration only. Other embodiments of the collapsible rack 2100 can be used without departing from the scope of this disclosure. The collapsible rack 2100 depicted in FIGS. 21 through 23 includes a number of components that are the same as or similar to components found in the collapsible rack 400 shown in FIG. 4. A detailed description of some of those components will be omitted here.

Figure 24:
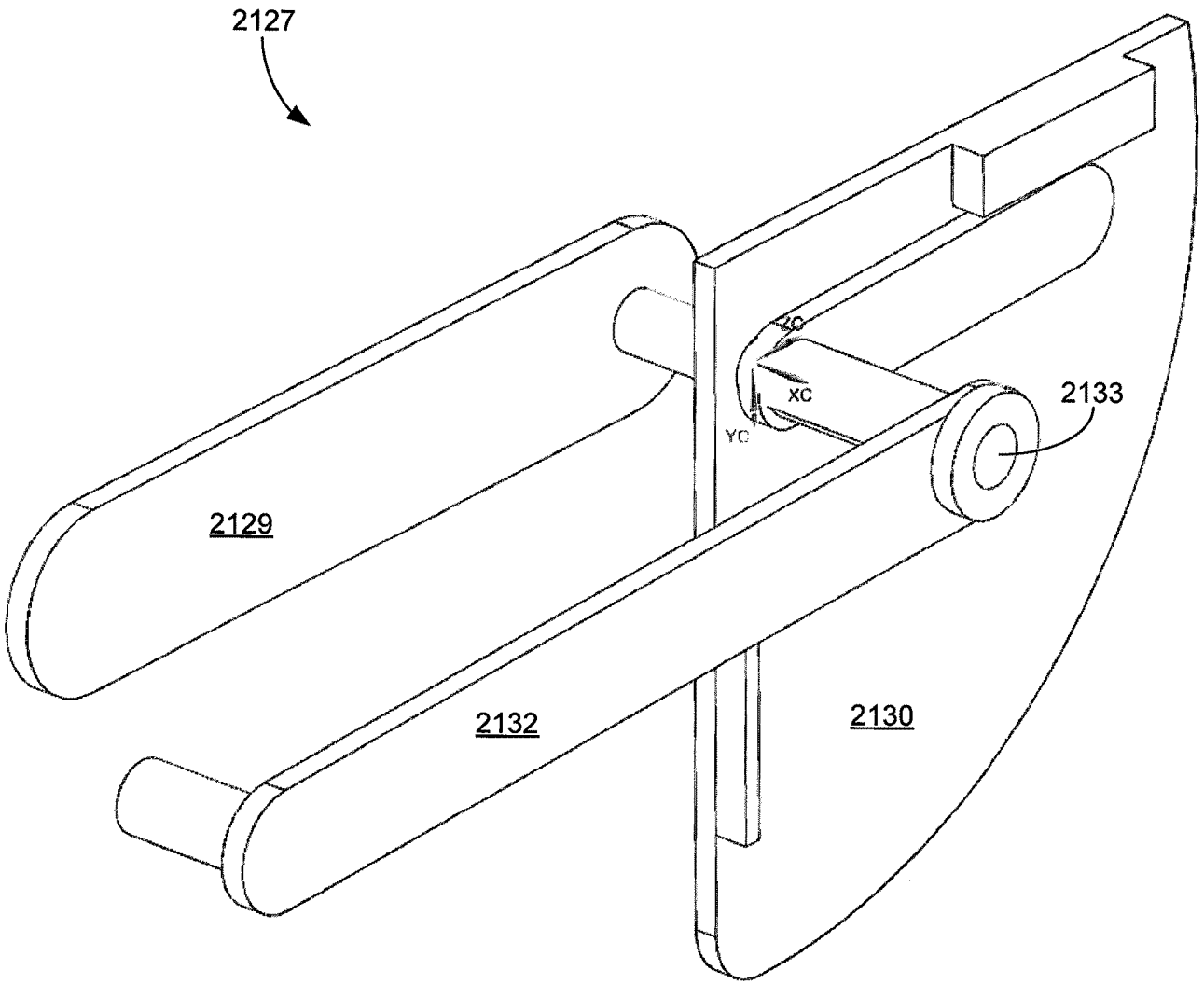
FIG. 24 illustrates a perspective view of one example of an adjustment mechanism of FIG. 21 according to this disclosure.

As shown in FIG. 21, the collapsible rack 2100 includes a rigid outside frame 2102 and a collapsible portion 2103. A handle 2105 on the outside frame 2102 allows a user to move the collapsible rack 2100 in and out of the dishwasher tub. The collapsible rack 2100 also includes a mounting element 2125 and an adjustment mechanism 2127 disposed on each of the left and right sides of the collapsible rack 2100. The mounting element 2125 includes a horizontal support 2131 and can be removably attached to an extendable rail 206 (shown in FIG. 3) that extends from the dishwasher tub. Each adjustment mechanism 2127 includes a lifting lever 2129, a cam 2130, a crank 2132, and a shaft 2133. FIG. 24 illustrates a perspective view of one example of the adjustment mechanism 2127. Each shaft 2133 is mounted in a bearing (not shown) that is attached to the outside frame 2102. The outside frame 2102 may be mounted on the mounting elements 2125, which are configured to slide vertically along sliding bearings of the mounting elements 2125.

The cam 2130 rests on a horizontal support 2131 of the mounting element 2125. The collapsible portion 2103 includes a frame 2104 that is configured to fit within the outside frame 2102, similar to the frame 412 in FIG. 4. The frame 2104 can rest on resting elements of the outside frame 2102. The sides of the frame 2104 can have linear slides that can slide along a linear rail 2107 of the outside frame 2102. Hard stops 2108 limit the movement of the frame 2104.

The collapsible portion 2103 is configured to be placed in any of three vertical positions relative to the dishwasher tub: lower (uncollapsed) position, middle position, and fully collapsed position. In FIG. 21, the collapsible rack 2100 and the collapsible portion 2103 are depicted in a lower (uncollapsed) position. That is, the collapsible rack 2100 is in a lower position, and the collapsible portion 2103 is in an uncollapsed position.

In the middle position, the collapsible rack 2100 is lifted within the dishwasher tub, and the collapsible portion 2103 remains in an uncollapsed position relative to the collapsible rack 2100. To move the collapsible portion 2103 to the middle position, the levers 2129 on each side of the collapsible rack 2100 may be actuated, e.g., rotated by a certain number of degrees, such as ninety degrees (or any other suitable range of motion between zero and 360 degrees, inclusive), as shown in FIG. 22. The rotation of each lever 2129 causes the corresponding cam 2130 and crank 2132 to rotate as well. In some embodiments, the cam 2130 and crank 2132 rotate by the same number of degrees as the lever 2129. In other embodiments, the cam 2130 and crank 2132 rotate by a greater or lesser number of degrees, e.g., due to optional gears or other coupling mechanisms. The resulting movement by the cam 2130 pushes the shaft 2133 and outside frame 2102 upward and away from the horizontal support 2131 of the mounting element 2125. Thus, the collapsible rack 2100 moves upward into an upper position and the collapsible portion 2103 moves with the collapsible rack 2100. However, the collapsible portion 2103 does not collapse (i.e., move) relative to the collapsible rack 2100.

To lift the collapsible portion 2103 to the fully collapsed position, the levers 2129 may be further rotated by a certain number of degrees, such as an additional ninety degrees (or any other suitable range of motion between zero and 360 degrees, inclusive), as shown in FIG. 23. The rotation of each lever 2129 causes the corresponding cam 2130 and crank 2132 to rotate as well. In this operation, the cam 2130 maintains the outside frame 2102 in the same upper position as shown in FIG. 22, while the crank 2132 lifts the collapsible portion 2103 upward relative to the outside frame 2102. Thus, the collapsed position of the collapsible portion 2103 can be achieved in one continuous operation by rotating the levers 2129 from the position shown in FIG. 21 to the position shown in FIG. 23 (e.g., a rotation of 180 degrees).

Lowering of the collapsible portion 2103 can be performed by rotating the levers 2129 in the opposite direction. The levers 2129 can be moved from the position shown in FIG. 23 to the position shown in FIG. 22 to move the collapsible portion 2103 to the middle position. Alternatively, the levers 2129 can be moved from the position shown in FIG. 23 to the position shown in FIG. 21 to return the collapsible portion 2103 to the lower, uncollapsed position.

While FIGS. 21 through 23 depict a collapsible portion 2103 that can be placed in three vertical positions, this is merely one example. Other embodiments can include more or fewer than three vertical positions.

Although the figures illustrate different examples of collapsible dish racks for use in a dishwasher, various changes may be made to the figures. For example, the dish racks shown can include any number of each component in any suitable arrangement. In general, the figures do not limit the scope of this disclosure to any particular configuration(s). Moreover, while figures illustrate operational environments in which various structural features disclosed in this patent document can be used, these features can be used in any other suitable system.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A dishwasher comprising:

a tub;

a first dish rack; and a second dish rack disposed above the first dish rack in the tub, the second dish rack comprising:

a frame configured to couple to and adjust in a vertical position relative to a plurality of mounting rails in the tub, a collapsible portion coupled to the frame and configured to adjust in a vertical position relative to the frame, and an adjustment device comprising a lever, a cam, and a crank, the adjustment device configured to:

adjust the frame relative to the plurality of mounting rails, and adjust the collapsible portion relative to the frame.

2. The dishwasher of claim 1, wherein the second dish rack further comprises:

a feed pipe coupled to the collapsible portion, the feed pipe having at least one connection point configured to align with at least one water supply point, wherein each vertical position of the collapsible portion corresponds to a different alignment of the at least one connection point and the at least one water supply point.

3. The dishwasher of claim 2, wherein the at least one connection point of the feed pipe comprises only one connection point and the at least one water supply point comprises a plurality of water supply points arranged vertically in a column on a back wall of the tub.

4. The dishwasher of claim 2, wherein the at least one connection point of the feed pipe comprises a plurality of connection points arranged vertically and the at least one water supply point comprises only one water supply point on a back wall of the tub.

5. The dishwasher of claim 1, wherein the collapsible portion is configured to be inclined to at least one of left, right, front, or rear relative to the frame.

6. The dishwasher of claim 1, wherein:

the adjustment device is coupled to the frame, the adjustment device having a full range of movement such that:

a first movement of the adjustment device through a first portion of the full range of movement adjusts the vertical position of the frame relative to the plurality of mounting rails, and a second movement of the adjustment device through a second portion of the full range of movement adjusts the vertical position of the collapsible portion relative to the frame.

7. The dishwasher of claim 6, wherein the full range of movement comprises a rotation of the lever through an arc.

8. The dishwasher of claim 7, wherein the lever adjusts to three positions, and the three positions include:

a lower position where the frame is at a lower position relative to the plurality of mounting rails and the collapsible portion is in a lower position relative to the frame, a middle position where the frame is in an upper position relative to the plurality of mounting rails and the collapsible portion is maintained in the lower position relative to the frame, and a fully collapsed position where the frame is maintained in the upper position relative to the plurality of mounting rails and the collapsible portion is lifted relative to the frame.

9. The dishwasher of claim 7, wherein the lever comprises a first lever disposed on a left side of the second dish rack and a second lever disposed on a right side of the second dish rack.

10. The dishwasher of claim 7, wherein:

the cam is configured to adjust the vertical position of the frame; and the crank is configured to adjust the vertical position of the collapsible portion relative to the frame.

11. A dish rack for use with a dishwasher, the dish rack comprising:

a frame configured to couple to and adjust in a vertical position relative to a plurality of mounting rails in a tub of the dishwasher; and a collapsible portion coupled to the frame and configured to adjust in a vertical position relative to the frame; and an adjustment device comprising a lever, a cam, and a crank, the adjustment device configured to:

adjust the frame relative to the plurality of mounting rails, and adjust the collapsible portion relative to the frame.

12. The dish rack of claim 11, further comprising:

a feed pipe coupled to the collapsible portion, the feed pipe having at least one connection point configured to align with at least one water supply point, wherein each vertical position of the collapsible portion corresponds to a different alignment of the at least one connection point and the at least one water supply point.

13. The dish rack of claim 12, wherein the at least one connection point of the feed pipe comprises only one connection point and the at least one water supply point comprises a plurality of water supply points arranged vertically in a column on a back wall of the tub.

14. The dish rack of claim 12, wherein the at least one connection point of the feed pipe comprises a plurality of connection points arranged vertically and the at least one water supply point comprises only one water supply point on a back wall of the tub.

15. The dish rack of claim 11, wherein the collapsible portion is configured to be inclined to at least one of left, right, front, or rear relative to the frame.

16. The dish rack of claim 11, wherein:

the adjustment device is coupled to the frame, the adjustment device having a full range of movement such that:

a first movement of the adjustment device through a first portion of the full range of movement adjusts the vertical position of the frame relative to the plurality of mounting rails, and a second movement of the adjustment device through a second portion of the full range of movement adjusts the vertical position of the collapsible portion relative to the frame.

17. The dish rack of claim 16, wherein the full range of movement comprises a rotation of the lever through an arc.

18. The dish rack of claim 17, wherein the lever adjusts to three positions, and the three positions include:

a lower position where the frame is at a lower position relative to the plurality of mounting rails and the collapsible portion is in a lower position relative to the frame, a middle position where the frame is in an upper position relative to the plurality of mounting rails and the collapsible portion is maintained in the lower position relative to the frame, and a fully collapsed position where the frame is maintained in the upper position relative to the plurality of mounting rails and the collapsible portion is lifted relative to the frame.

19. The dish rack of claim 17, wherein the lever comprises a first lever disposed on a left side of the dish rack and a second lever disposed on a right side of the dish rack.

20. The dish rack of claim 17, wherein:

the cam is configured to adjust the vertical position of the frame; and the crank is configured to adjust the vertical position of the collapsible portion relative to the frame.

* * * * *